US011705270B2

(12) United States Patent
Asai et al.

(10) Patent No.: US 11,705,270 B2
(45) Date of Patent: Jul. 18, 2023

(54) COIL COMPONENT

(71) Applicant: TDK CORPORATION, Tokyo (JP)

(72) Inventors: Miyuki Asai, Tokyo (JP); Hokuto Eda, Tokyo (JP); Masazumi Arata, Tokyo (JP); Hitoshi Ohkubo, Tokyo (JP)

(73) Assignee: TDK CORPORATION, Tokyo (JP)

( * ) Notice: Subject to any disclaimer, the term of this patent is extended or adjusted under 35 U.S.C. 154(b) by 361 days.

(21) Appl. No.: 16/877,772

(22) Filed: May 19, 2020

(65) Prior Publication Data

US 2020/0373064 A1 Nov. 26, 2020

(30) Foreign Application Priority Data

May 21, 2019 (JP) ..... 2019-095131

(51) Int. Cl.
*H01F 27/28* (2006.01)
*H01F 27/255* (2006.01)
*H01F 27/32* (2006.01)

(52) U.S. Cl.
CPC ..... *H01F 27/2804* (2013.01); *H01F 27/255* (2013.01); *H01F 27/324* (2013.01); *H01F 2027/2809* (2013.01)

(58) Field of Classification Search
None
See application file for complete search history.

(56) References Cited

U.S. PATENT DOCUMENTS 9,899,143 B2 * 2/2018 Kim ..... H01F 41/046
9,976,224 B2 * 5/2018 Jeong ..... C25D 5/10
10,943,719 B2 * 3/2021 Asai ..... H01F 17/0013
11,004,595 B2 * 5/2021 Yang ..... H01F 41/046
11,569,024 B2 * 1/2023 Onuma ..... H01F 27/323
2015/0255206 A1 * 9/2015 Han ..... H01F 41/046 336/192
2018/0261377 A1 9/2018 Kim
2020/0373061 A1 * 11/2020 Asai ..... H01F 27/292
2020/0373077 A1 * 11/2020 Onuma ..... H01F 27/2871
2021/0151248 A1 * 5/2021 Oh ..... H01F 27/29
2021/0327637 A1 * 10/2021 Eda ..... H01F 27/292

FOREIGN PATENT DOCUMENTS

JP 2017-17139 A 1/2017
JP 2017204629 A * 11/2017 ..... H01F 17/0013
JP 2018-148200 A 9/2018
KR 20190106620 A * 9/2019

OTHER PUBLICATIONS

Translation of KR20190106620A Jung et al Publish on Sep. 18, 2019 (Year: 2019).*
Nov. 22, 2022 Office Action issued in Japanese Application No. 2019-095131.

* cited by examiner

*Primary Examiner* — Jermele M Hollington
(74) *Attorney, Agent, or Firm* — Oliff PLC

(57) ABSTRACT

In a coil component, an uneven structure provided by an insulation layer and a resin wall contributes to extension of a contact area with respect to a magnetic body, so that an adhesive force with respect to the magnetic body is improved. In addition, the magnetic body protrudes downward toward an exposed region of the resin wall corresponding to a recessed portion in the uneven structure, a volume thereof is increased, and coil characteristics such as an inductance value are improved.

6 Claims, 7 Drawing Sheets

COIL COMPONENT

CROSS-REFERENCE TO RELATED APPLICATIONS

This application is based upon and claims the benefit of priority from Japanese Patent Application No. 2019-95131, filed on 21 May, 2019, the entire contents of which are incorporated herein by reference.

TECHNICAL FIELD

The present disclosure relates to a coil component.

BACKGROUND

Regarding a coil component in the related art, for example, Japanese Unexamined Patent Publication No. 2018-148200 discloses a coil component which includes a coil pattern that is provided on an insulation substrate, a resin wall that defines a region for forming a flat coil pattern on the insulation substrate, and a metal magnetic powder-containing resin that integrally covers the coil pattern and the resin wall; and in which an insulation layer is interposed between a coil and the metal magnetic powder-containing resin.

SUMMARY

In a coil component according to the technology in the related art described above, there is room for further enhancing an adhesive force between an insulation layer and a metal magnetic powder-containing resin. The inventors have newly found a technology in which coil characteristics can be improved by increasing a volume of a magnetic body above a coil pattern while an adhesive force between an insulation layer and a metal magnetic powder-containing resin is enhanced.

According to the present disclosure, a coil component having an improved adhesive force between an insulation layer and a metal magnetic powder-containing resin and improved coil characteristics is provided.

According to an aspect of the present disclosure, there is provided a coil component including an insulation substrate, a coil having a flat coil pattern formed on at least one surface of the insulation substrate, a resin wall being provided on the insulation substrate and defining a region for forming the flat coil pattern, an insulation layer integrally covering an outer surface of the flat coil pattern and a part of each of the resin walls having the flat coil pattern interposed therebetween, and a magnetic body integrally covering the insulation substrate, the flat coil pattern, and the insulation layer and coining into contact with the resin wall in an exposed region exposed from the insulation layer. The magnetic body is a magnetic powder-containing resin including metal magnetic powders and a resin. An upper end position of the insulation layer and an upper end position of the resin wall differ from each other on the basis of the insulation substrate.

In the coil component, since the upper end position of the insulation layer and the upper end position of the resin wall differ from each other, an uneven structure is provided on an upper side of the flat coil pattern. The uneven structure provided by the insulation layer and the resin wall contributes to extension of a contact area with respect to the magnetic body, so that an adhesive force with respect to the magnetic body is improved. In addition, a volume of the magnetic body is increased in a part coming into contact with the resin wall in the exposed region exposed from the insulation layer, so that coil characteristics are improved.

In the coil component according to the aspect of the present disclosure, the magnetic powder-containing resin may include a plurality of metal magnetic powders having different average particle sizes. A width of the exposed region of the resin wall may be larger than an average particle size of the metal magnetic powders having a smallest average particle size.

In the coil component according to the aspect of the present disclosure, a height of the resin wall on the basis of the insulation substrate may be higher than a height of the flat coil pattern.

DETAILED DESCRIPTION

Figure 1:
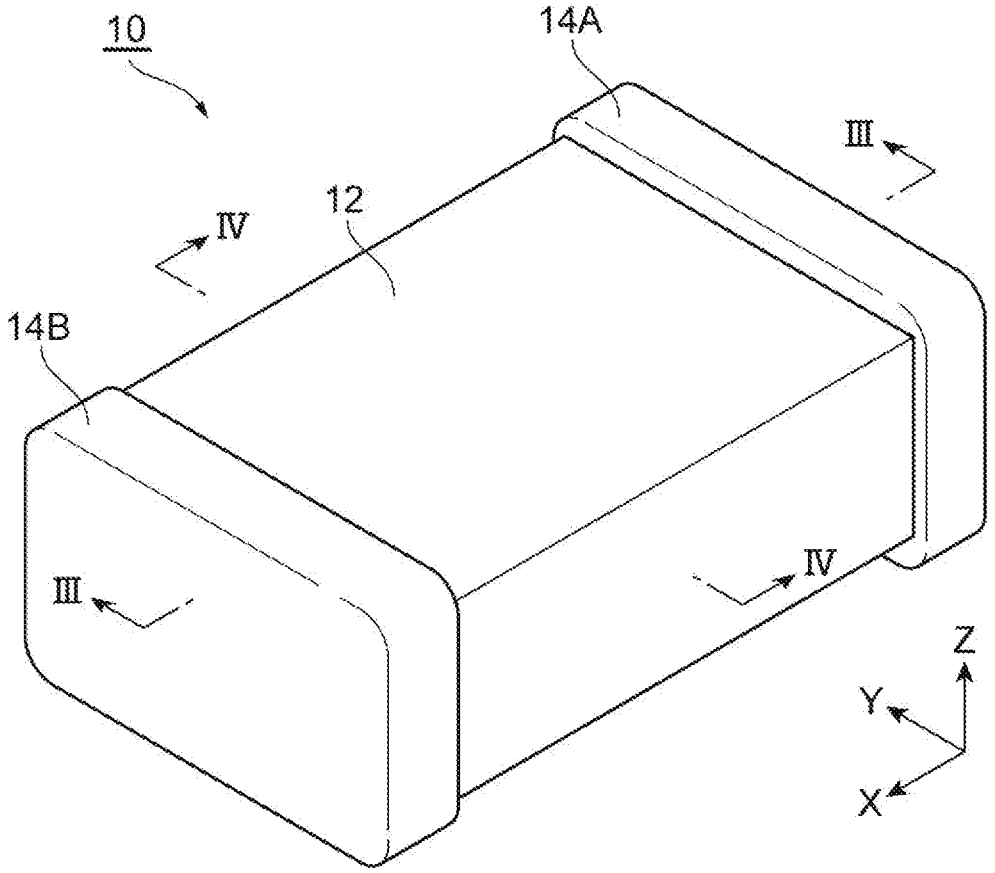
FIG. 1 is a schematic perspective view of a coil component according to an embodiment.
Figure 2:
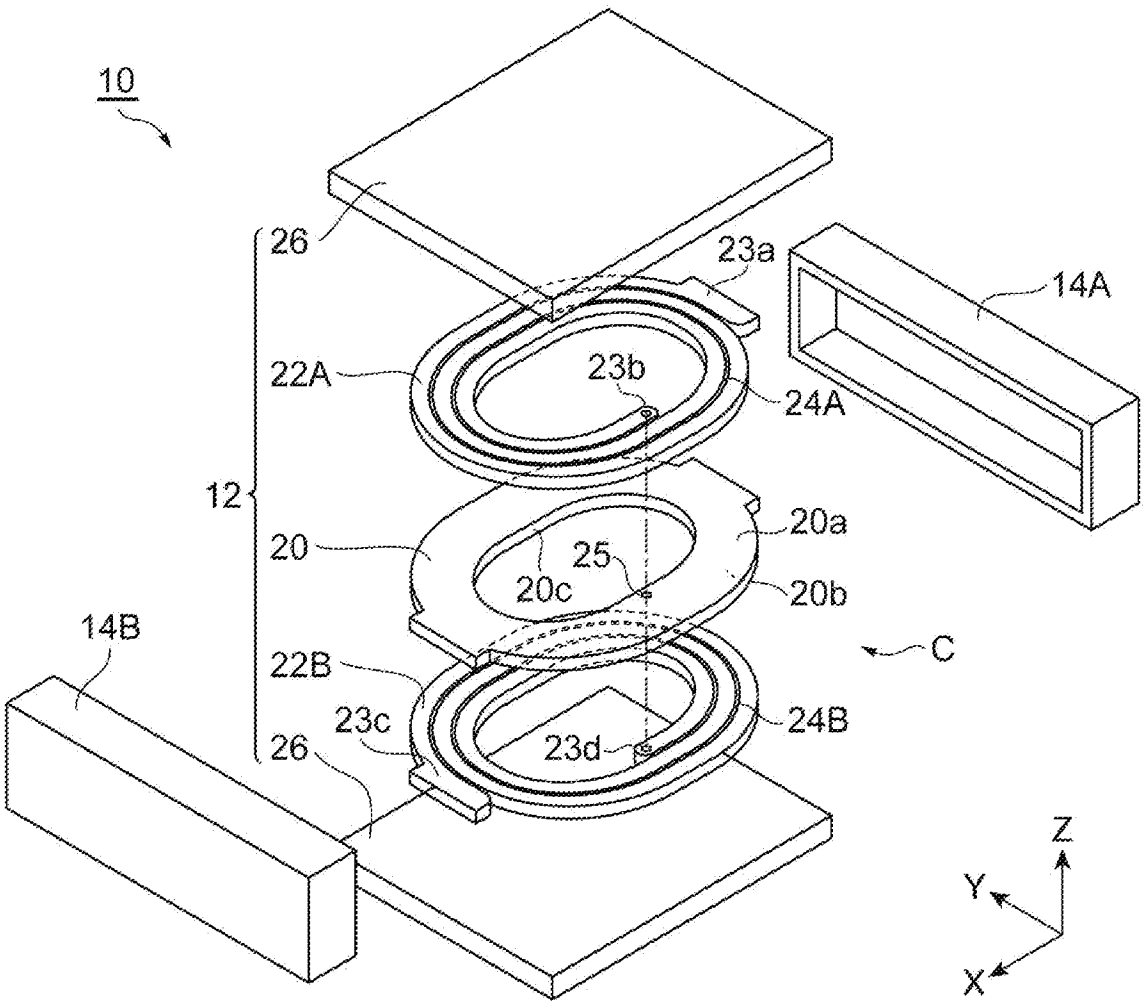
FIG. 2 is an exploded view of the coil component shown in FIG. 1.

Hereinafter, with reference to the accompanying drawings, an embodiment of the present disclosure will be described in detail. In the description, the same reference signs are used for the same elements or elements having the same function, and duplicate description will be omitted.

With reference to FIGS. 1 to 4, a structure of a coil component according to the embodiment will be described. For the sake of convenience of description, an XYZ coordinate system is set as shown in the diagrams. That is, a thickness direction of the coil component is set to a Z direction, a direction in which external terminal electrodes face each other is set to an X direction, and a direction orthogonal to the Z direction and the X direction is set to a Y direction.

A coil component 10 is a flat coil element and is constituted of a main body portion 12 which exhibits a rectangular parallelepiped shape, and a pair of external terminal electrodes 14A and 14B which are provided on an outer surface of the main body portion 12. The pair of external terminal electrodes 14A and 14B are provided such that the whole surfaces of a pair of end surfaces 12*a* and 12*b* facing each other in the X direction are covered. As an example, the coil component 10 is designed to have dimensions of a long side of 2.5 mm, a short side of 2.0 mm, and a height within a range of 0.8 to 1.0 mm.

The main body portion 12 is configured to include an insulation substrate 20, a coil C provided in the insulation substrate 20, and a magnetic body 26.

The insulation substrate 20 is a plate-shaped member constituted of a non-magnetic insulating material and has a substantially elliptical ring shape when viewed in the thickness direction thereof. An elliptical penetration hole 20*c* is provided in a central part of the insulation substrate 20. A substrate in which a glass cloth is impregnated with an epoxy-based resin and which has a plate thickness within a range of 10 μm to 60 μm can be used as the insulation substrate 20. Not only an epoxy-based resin but also a BT resin, polyimide, aramid, or the like can be used. Regarding a material for the insulation substrate 20, ceramic or glass can also be used. Regarding a material for the insulation substrate 20, a material for mass-produced printed boards may be adopted, or a resin material used for BT printed boards, FR4 printed boards, or FR5 printed boards may be adopted.

The coil C has a first coil portion 22A which is subjected to insulation coating with a first conductor pattern 23A for a flat air-core coil provided on one surface 20*a* (upper surface in FIG. 2) of the insulation substrate 20, a second coil portion 22B which is subjected to insulation coating with a second conductor pattern 23B for a flat air-core coil provided on the other surface 20*b* (lower surface in FIG. 2) of the insulation substrate 20, and a through-hole conductor 25 which connects the first conductor pattern 23A and the second conductor pattern 23B to each other. That is, the coil C includes two conductor patterns 23 (flat coil patterns), that is, the first conductor pattern 23A and the second conductor pattern 23B.

The first conductor pattern 23A is a flat spiral pattern serving as a flat air-core coil and is formed through plating using a conductor material such as Cu. The first conductor pattern 23A is formed to be wound around the penetration hole 20*c* of the insulation substrate 20. More specifically, the first conductor pattern 23A is wound in three clockwise turns toward the outward side when viewed in the upward direction (Z direction). The height of the first conductor pattern 23A (length in the thickness direction of the insulation substrate 20) is the same throughout the entire length.

An end portion 22*a* of the first conductor pattern 23A on the outward side is exposed on the end surface 12*a* of the main body portion 12 and is connected to the external terminal electrode 14A covering the end surface 12*a*. An end portion 23*b* of the first conductor pattern 23A on the inward side is connected to the through-hole conductor 25.

Similar to the first conductor pattern 23A, the second conductor pattern 23B is also a flat spiral pattern serving as a flat air-core coil and is formed through plating using a conductor material such as Cu. The second conductor pattern 23B is also formed to be wound around the penetration hole 20*c* of the insulation substrate 20. More specifically, the second conductor pattern 23B is wound in three counterclockwise turns toward the outward side when viewed in the upward direction (Z direction). That is, the second conductor pattern 23B is wound in a direction opposite to that of the first conductor pattern 23A when viewed in the upward direction. The height of the second conductor pattern 23B is the same throughout the entire length and can be designed to have the same height as that of the first conductor pattern 23A.

An end portion 23*c* of the second conductor pattern 23B on the outward side is exposed on the end surface 12*b* of the main body portion 12 and is connected to the external terminal electrode 14B covering the end surface 12*b*. An end portion 23*d* of the second conductor pattern 23B on the inward side is positionally aligned with the end portion 23*b* of the first conductor pattern 23A on the inward side in the thickness direction of the insulation substrate 20 and is connected to the through-hole conductor 25.

The through-hole conductor 25 is provided such that it penetrates an edge region of the penetration hole 20*c* of the insulation substrate 20 and connects the end portion 23*b* of the first conductor pattern 23A and the end portion 23*d* of the second conductor pattern 23B to each other. The through-hole conductor 25 can be constituted of a hole provided in the insulation substrate 20 and a conductive material (for example, a metal material such as Cu) filling the hole. The through-hole conductor 25 has a substantially columnar or a substantially prismatic external shape extending in the thickness direction of the insulation substrate 20.

Figure 3:
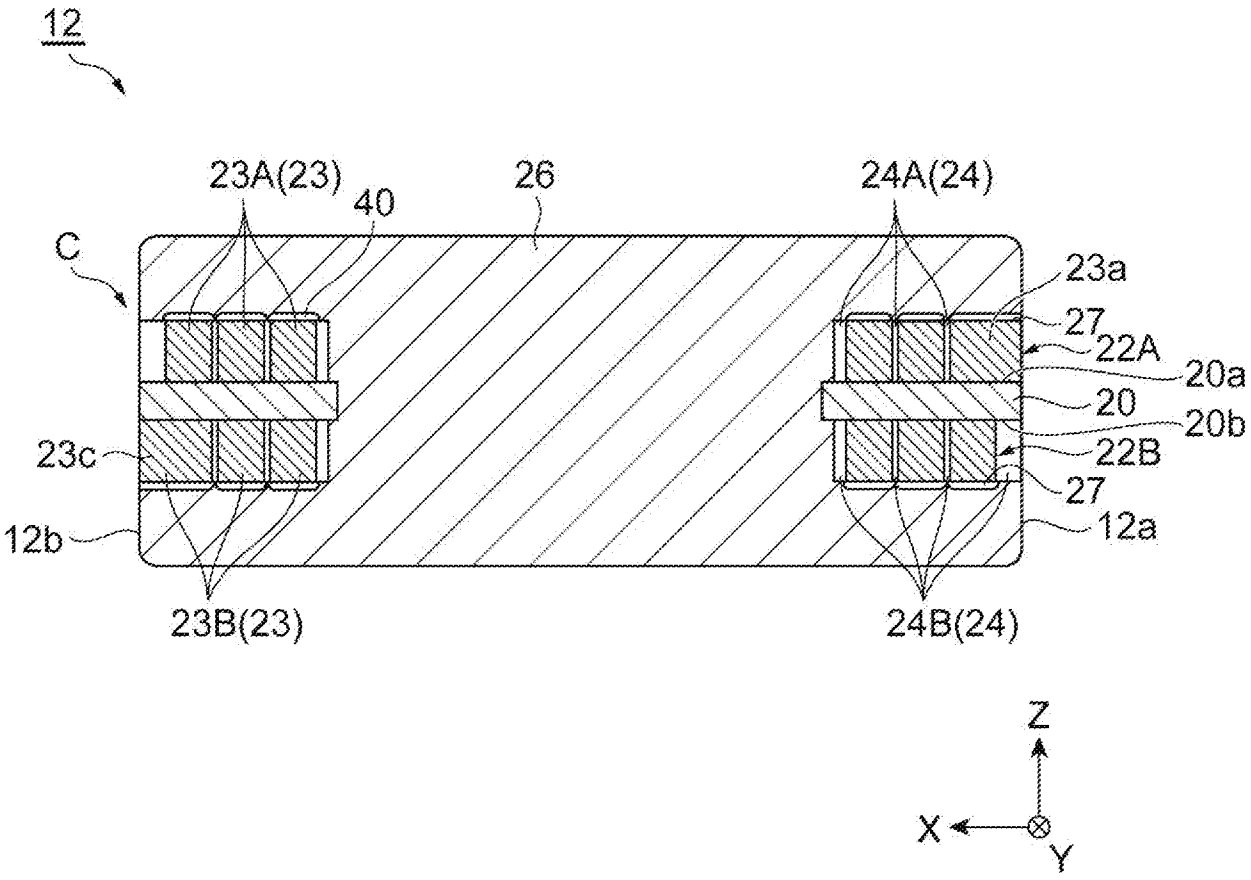
FIG. 3 is a cross-sectional view along line III-III in the coil component shown in FIG. 1.
Figure 4:
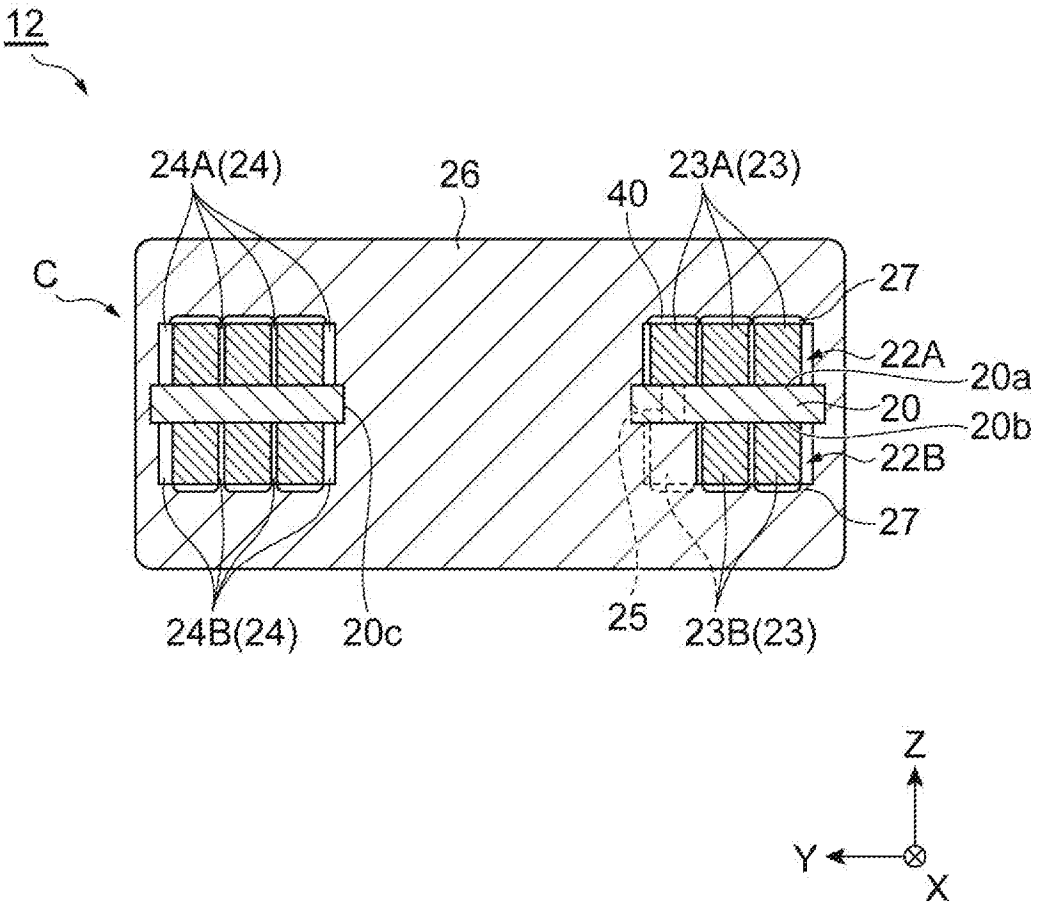
FIG. 4 is a cross-sectional view along line IV-IV in the coil component shown in FIG. 1.

In addition, as shown in FIGS. 3 and 4, each of the first coil portion 22A and the second coil portion 22B has a resin wall 24. In the resin walls 24, a resin wall 24A of the first coil portion 22A is positioned between lines and on the inner circumference and the outer circumference of the first conductor pattern 23A, and a resin wall 24B of the second coil portion 22B is positioned between lines and on the inner circumference and the outer circumference of the second conductor pattern 23B. In the present embodiment, the resin walls 24A and 24B positioned on the inner circumferences and the outer circumferences of the conductor patterns 23A and 23B are designed to be thicker than the resin walls 24A and 24B positioned between lines of the conductor patterns 23A and 23B.

The resin walls 24 are constituted of an insulating resin material. The resin walls 24 can be provided on the insulation substrate 20 before the conductor patterns 23 are formed. In this case, the conductor patterns 23 are subjected to plating growth between walls defined by the resin walls 24. That is, regions for forming the conductor patterns 23 are defined by the resin walls 24 provided on the insulation substrate 20. The resin walls 24 can be provided on the insulation substrate 20 after the conductor patterns 23 are formed. In this case, the resin walls 24 are provided in the conductor patterns 23 through filling, painting, or the like.

The height of resin wall 24 (that is, the height on the basis of the insulation substrate 20) is designed to be higher than the height of the conductor pattern 23. For this reason, compared to when the height of the resin wall 24 and the height of the conductor pattern 23 are the same, a creepage distance between conductor patterns 23 adjacent to each other with the resin wall 24 therebetween is extended. Accordingly, a situation in which a short circuit occurs between conductor patterns 23 adjacent to each other is curbed.

The magnetic body 26 integrally covers the insulation substrate 20 and the coil C. More specifically, the magnetic body 26 covers the insulation substrate 20 and the coil C in an up-down direction and covers the outer circumference of the insulation substrate 20 and the coil C. In addition, the magnetic body 26 fills the inside of the penetration hole 20*c* of the insulation substrate 20 and an inward region of the coil C.

The magnetic body 26 is constituted of a metal magnetic powder-containing resin. The metal magnetic powder-containing resin is a binding powdery substance in which a metal magnetic powdery substance is bound with a binder resin. For example, the metal magnetic powders of the metal magnetic powder-containing resin constituting the magnetic body 26 are constituted of an iron-nickel alloy (permalloy alloy), carbonyl iron, amorphous, a non-crystalline or crystalline FeSiCr-based alloy, or Sendust. For example, the binder resin is a thermosetting epoxy resin. In the present embodiment, a metal magnetic powdery substance content in the binding powdery substance is within a range of 80 to 92 vol % in percent by volume and is within a range of 95 to 99 wt % in percent by mass. From the viewpoint of magnetic characteristics, the metal magnetic powdery substance content in the binding powdery substance may be within a range of 85 to 92 vol % in percent by volume and may be within a range of 97 to 99 wt % in percent by mass. The metal magnetic powders of the metal magnetic powder-containing resin constituting the magnetic body 26 may be a powdery substance having an average particle size of one kind or may be a powder mix having an average particle size of a plurality of kinds. In the present embodiment, the metal magnetic powders of the metal magnetic powder-containing resin constituting the magnetic body 26 are a powder mix having average particle sizes of three kinds. When the metal magnetic powders of the metal magnetic powder-containing resin constituting the magnetic body 26 are in a powder mix, the kinds of the metal magnetic powders having different average particle sizes may be the same or may vary.

Figure 5:
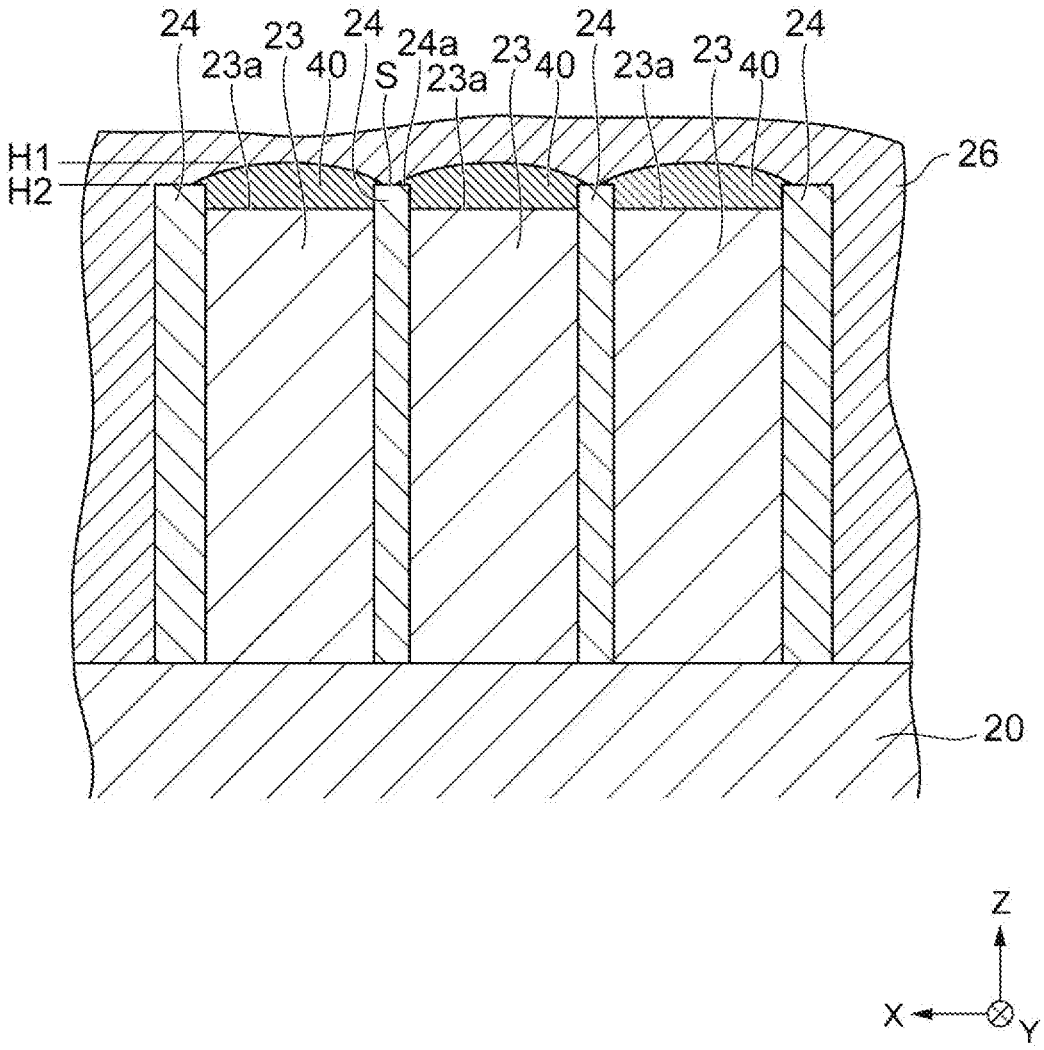
FIG. 5 is an enlarged view of a main part in the cross section shown in FIG. 3.

As shown in FIG. 5, an insulation layer 40 is interposed between the magnetic body 26 and the conductor pattern 23. The insulation layer 40 integrally covers an outer surface 23*a* (that is, an upper surface) of the conductor pattern 23 and a part of outer surfaces 24*a* (that is, upper end surfaces) of the resin walls 24 on both sides having the conductor pattern 23 interposed therebetween. On the upper end surface 24*a* thereof, the resin wall 24 has an exposed region S which is not covered by the insulation layer 40 and is exposed from the insulation layer 40. The insulation layer 40 is constituted of a resin such as an epoxy resin or a polyimide resin, for example. In the present embodiment, the insulation layer 40 is an electrodeposited layer formed by using an electrodeposition method.

The insulation layer 40 has an outer surface curved in a concave shape in which an upper end position H1 of the insulation layer 40 on the basis of the insulation substrate 20 is present at an intermediate position between the resin walls 24 having the conductor pattern 23 interposed therebetween. The upper end position H1 of the insulation layer 40 is different from an upper end position H2 of the resin wall 24, and the position H1 is at a position higher than the position H2. For this reason, an uneven structure is provided on an upper side of the conductor patterns 23 by the insulation layers 40 and the resin walls 24. Further, the magnetic body 26 is provided along this uneven structure and comes into contact with the upper end surfaces 24*a* of the resin walls 24 in the exposed region S (that is, a recessed portion in the uneven structure) exposed from the insulation layer 40.

In the coil component 10 described above, the uneven structure provided by the insulation layers 40 and the resin walls 24 contributes to extension of a contact area with respect to the magnetic body 26, so that an adhesive force with respect to the magnetic body 26 is improved. In addition, the magnetic body 26 protrudes downward toward the exposed regions S of the resin walls 24 corresponding to the recessed portions in the uneven structure, the volume thereof is increased, and coil characteristics such as an inductance value are improved.

Figure 6:
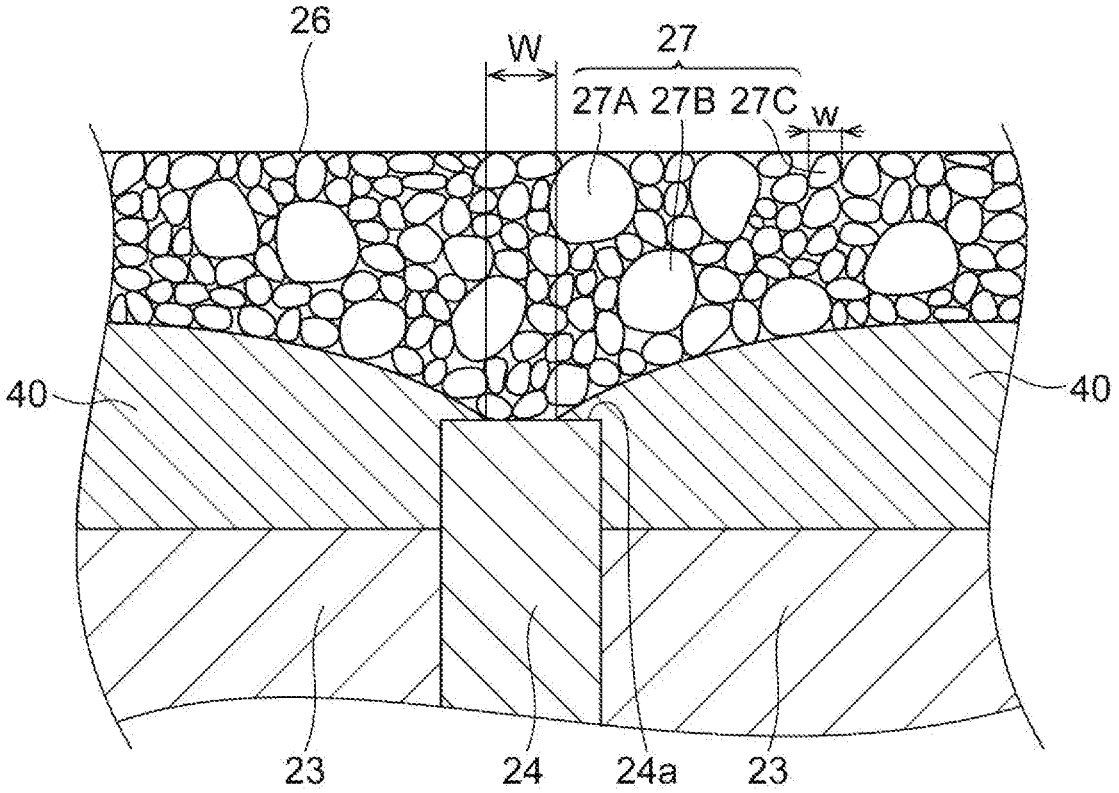
FIG. 6 is an enlarged view of a main part in the cross section shown in FIG. 5.

As shown in FIG. 6, metal magnetic powders 27 are included in a part of the magnetic body 26 protruding downward. In the metal magnetic powders 27, the particle size of magnetic powders (large particle powders) 27A having the largest average particle size can be within a range of 15 to 30 μm, the particle size of magnetic powders (small particle powders) 27C having the smallest average particle size can be within a range of 0.3 to 1.5 μm, and magnetic powders (intermediate powders) 27B having an average particle size between those of the large particle powders and the small particle powders can be within a range of 3 to 10 μm. 100 parts by weight of a powder mix may include large particle powders within a range of 60 to 80 parts by weight, intermediate particle powders within a range of 10 to 20 parts by weight, and small particle powders within a range of 10 to 20 parts by weight. The average particle size of the metal magnetic powders 27 is stipulated by the particle size (d50, a so-called median size) at 50% of the integrated value in a particle size distribution and is obtained as follows. A scanning electron microscope (SEM) photograph of a cross section of the magnetic body 26 is captured. The captured SEM photograph is subjected to image processing using software, boundaries of the metal magnetic powders 27 are distinguished, and the area of the metal magnetic powders 27 is calculated. The particle size is calculated by converting the calculated area of the metal magnetic powders 27 into an equivalent circle diameter. For example, the particle sizes of 100 or more metal magnetic powders 27 are calculated, and a particle size distribution of these metal magnetic powders 27 is obtained. The particle size at 50% of the integrated value in the obtained particle size distribution is referred to as the average particle size d50. The particle shapes of the metal magnetic powders 27 are not particularly limited.

A width W of the exposed region S of the resin wall 24 can be designed to be larger than the particle size of the metal magnetic powders 27 included in the magnetic body 26. For example, when a metal magnetic powder-containing resin constituting the magnetic body 26 includes a plurality of magnetic powders 27A, 27B, and 27C having different average particle sizes, the width W of the exposed region S of the resin wall 24 can be designed to be larger than an average particle size w of magnetic powders (small particle powders 27C) having the smallest average particle size. The width W of the exposed region S of the resin wall 24 is within a range of 5 to 20 μm, for example.

Figure 7:
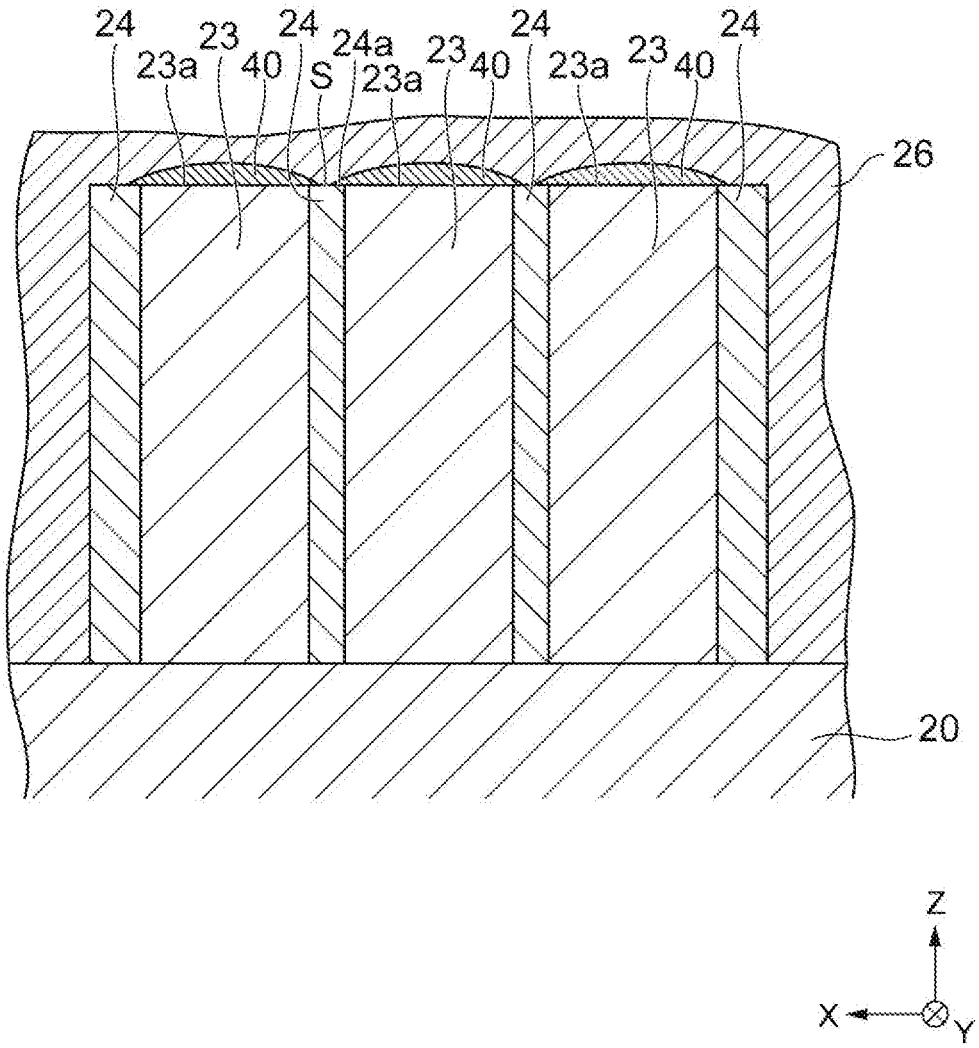
FIG. 7 is an enlarged view of a main part in a cross section in a form different from that in FIG. 5.

As shown in FIG. 7, a form in which the height of the resin wall 24 and the height of the conductor pattern 23 are the same and the outer surface 24*a* of the resin wall 24 and the outer surface 23*a* of the conductor pattern 23 are flush with each other may be adopted. Even in this form, the uneven structure provided by the insulation layers 40 and the resin walls 24 contributes to extension of a contact area with respect to the magnetic body 26, so that an adhesive force with respect to the magnetic body 26 is improved. In addition, the magnetic body 26 protrudes downward toward the exposed region S of the resin wall 24 corresponding to the recessed portion in the uneven structure, the volume thereof is increased, and coil characteristics such as an inductance value are improved.

What is claimed is:

1. A coil component comprising:

an insulation substrate;

a coil having a flat coil pattern formed on at least one surface of the insulation substrate;

a resin wall provided on the insulation substrate and defining a region for forming the flat coil pattern;

an insulation layer integrally covering an outer surface of the flat coil pattern and a part of the resin wall in areas adjacent the flat coil pattern; and a magnetic body integrally covering the insulation substrate, the flat coil pattern, and the insulation layer and coming into contact with the resin wall in an exposed region exposed from the insulation layer, wherein:

the magnetic body is a magnetic powder-containing resin including metal magnetic powders and a resin, an upper end position of the insulation layer and an upper end position of the resin wall differ from each other on the basis of the insulation substrate, the resin wall has a cross-sectional shape extending in a thickness direction of the substrate, the cross-sectional shape of the resin wall having a first end formed on the at least one surface of the insulation substrate and a second end opposite the first end, and a part of the resin wall exposed from the insulating layer is a part of the second end of the resin wall.

2. The coil component according to claim 1, wherein the magnetic powder-containing resin includes a plurality of metal magnetic powders having different average particle sizes, and wherein a width of the exposed region of the resin wall is larger than an average particle size of the metal magnetic powders having a smallest average particle size.

3. The coil component according to claim 1, wherein a height of the resin wall on the basis of the insulation substrate is higher than a height of the flat coil pattern.

4. The coil component according to claim 2, wherein a height of the resin wall on the basis of the insulation substrate is higher than a height of the flat coil pattern.

5. A coil component comprising:

an insulation substrate;

a coil having a flat coil pattern formed on at least one surface of the insulation substrate;

a resin wall provided on the insulation substrate and defining a region for forming the flat coil pattern;

an insulation layer integrally covering an outer surface of the flat coil pattern and a part of each of the resin walls having the flat coil pattern interposed therebetween; and a magnetic body integrally covering the insulation substrate, the flat coil pattern, and the insulation layer and coming into contact with the resin wall in an exposed region exposed from the insulation layer, wherein:

the magnetic body is a magnetic powder-containing resin including metal magnetic powders and a resin, an upper end position of the insulation layer and an upper end position of the resin wall differ from each other on the basis of the insulation substrate, the magnetic powder-containing resin includes a plurality of metal magnetic powders having different average particle sizes, a width of the exposed region of the resin wall is larger than an average particle size of the metal magnetic powders having a smallest average particle size, and the plurality of metal magnetic powders comprises largest particles having an average particle size within a range of 15 to 30 μm, smallest particles having an average particle size within a range of 0.3 to 1.5 μm, and particles having an average particle size intermediate between those of the largest particles and the smallest particles within a range of 3 to 10 μm.

6. The coil component according to claim 5, wherein, based on a total of 100 parts by weight, the largest particles are present within a range of 60 to 80 parts by weight, the intermediate particles are present within a range of 10 to 20 parts by weight, and smallest particles are present within a range of 10 to 20 parts by weight.

* * * * *